US009739447B2

(12) United States Patent
Ohno et al.

(10) Patent No.: US 9,739,447 B2
(45) Date of Patent: Aug. 22, 2017

(54) LIGHTING APPARATUS

(71) Applicant: MINEBEA CO., LTD., Kitasaku-gun, Nagano (JP)

(72) Inventors: Yasuo Ohno, Iwata (JP); Rumiko Tanaka, Fukuroi (JP)

(73) Assignee: MINEBEA CO., LTD, Nagano (JP)

( * ) Notice: Subject to any disclaimer, the term of this patent is extended or adjusted under 35 U.S.C. 154(b) by 64 days.

(21) Appl. No.: 14/842,257

(22) Filed: Sep. 1, 2015

(65) Prior Publication Data

US 2016/0084474 A1 Mar. 24, 2016

(30) Foreign Application Priority Data

Sep. 19, 2014 (JP) ..... 2014-191708

(51) Int. Cl.

| | |
|---|---|
| ***F21V 7/00*** | (2006.01) |
| ***F21V 13/04*** | (2006.01) |
| ***F21V 3/00*** | (2015.01) |
| *F21Y 103/10* | (2016.01) |
| *F21Y 115/10* | (2016.01) |

(52) U.S. Cl.

CPC ..... *F21V 7/0041* (2013.01); *F21V 7/0008* (2013.01); *F21V 3/00* (2013.01); *F21V 7/005* (2013.01); *F21V 7/0058* (2013.01); *F21Y 2103/10* (2016.08); *F21Y 2115/10* (2016.08)

(58) Field of Classification Search

CPC .... F21V 7/0041; F21V 7/0058; F21V 7/0008; F21V 7/005; G02F 1/133615; G02F 1/133605

See application file for complete search history.

(56) References Cited

U.S. PATENT DOCUMENTS

| | | | | |
|---|---|---|---|---|
| 7,229,198 | B2 * | 6/2007 | Sakai | G02B 6/0096 362/225 |
| 8,425,101 | B2 | 4/2013 | Boonekamp | |
| 8,616,754 | B2 * | 12/2013 | Ko | G02B 6/0031 362/608 |
| 8,944,624 | B2 * | 2/2015 | Kim | G02F 1/133608 362/249.02 |
| 8,960,966 | B2 * | 2/2015 | Ko | G02B 6/0046 362/298 |
| 9,068,716 | B2 * | 6/2015 | Kang | F21V 7/048 |

(Continued)

FOREIGN PATENT DOCUMENTS

| | | |
|---|---|---|
| JP | 2005-214790 A | 8/2005 |
| JP | 2009-252447 A | 10/2009 |

(Continued)

OTHER PUBLICATIONS

Mar. 15, 2017 Office Action issued in Japanese Patent Application No. 2014-191708.

*Primary Examiner* — Alan Cariaso
(74) *Attorney, Agent, or Firm* — Oliff PLC

(57) ABSTRACT

A lighting apparatus includes: a plurality of light sources; a first frame including a first reflection surface disposed inside of the light sources, the first reflection surface reflecting, in a forward direction, light emitted from the light sources; a second frame including a visor portion covering fronts of the light sources; and a diffuser disposed in front of a front surface of the visor portion with a distance left between the diffuser and at least a part of the front surface of the visor portion.

9 Claims, 5 Drawing Sheets

(56) References Cited

U.S. PATENT DOCUMENTS

| | | | |
|---|---|---|---|
| 2006/0018901 | A1 | 1/2006 | Loibner et al. |
| 2007/0147036 | A1 | 6/2007 | Sakai et al. |
| 2010/0321919 | A1 | 12/2010 | Yang |
| 2011/0211335 | A1 | 9/2011 | Ko |
| 2014/0268754 | A1 | 9/2014 | Ko |
| 2014/0340910 | A1 | 11/2014 | Goldstein et al. |

FOREIGN PATENT DOCUMENTS

| | | | |
|---|---|---|---|
| JP | 2010-528444 | A | 8/2010 |
| JP | 4705470 | B2 | 6/2011 |
| JP | 2012-124136 | A | 6/2012 |
| JP | 2012-531047 | A | 12/2012 |
| WO | 2013/041993 | A2 | 3/2013 |

* cited by examiner

LIGHTING APPARATUS

CROSS-REFERENCE TO RELATED APPLICATIONS

The present application claims priority to and incorporates by reference the entire contents of Japanese Patent Application No. 2014-191708 filed in Japan on Sep. 19, 2014.

BACKGROUND OF THE INVENTION

1. Field of the Invention

The present invention generally relates to a lighting apparatus, and more particularly, to a lighting apparatus that guides light emitted from light sources without using a solid light guide to emit planar illuminating light.

2. Description of the Related Art

Conventionally a lighting apparatus such as a hollow side-lit lighting apparatus that emits a planar illuminating light by guiding a light emitted from a light source without using a solid light guide has been known. In a typical hollow side-lit lighting apparatus, light sources such as light emitting diodes (LEDs) are disposed such that they are covered by a frame when seen from an illuminated side. Most of the illuminating light emitted from the light-emitting surface of the lighting apparatus is indirect light reflected on a reflector disposed inside the frame that reflects light emitted from the light sources (see, for example, Japanese Translation of PCT Application No. 2010-528444 and Japanese Laid-open Patent Publication No. 2005-214790).

The hollow side-lit lighting apparatus is more advantageous than a direct-type lighting apparatus that includes light sources immediately behind the light-emitting surface and mainly emits direct light from the light sources through a diffuser, in that, the hollow side-lit lighting apparatus can reduce unevenness in brightness and glare (strong and dazzling light) on the light-emitting surface when seen from the illuminated side.

The conventional hollow side-lit lighting apparatus includes a non-light-emitting surface (hereinafter also referred to as a rim frame) that is a part of the frame covering the light sources when seen from the illuminated side. The non-light-emitting surface reduces the area that can be used as the actual light-emitting surface on the light-emitting side of the lighting apparatus, relative to a whole surface area on the light-emitting side. Some lighting apparatuses need a narrower rim frame for a decorative (design) purpose.

SUMMARY OF THE INVENTION

It is an object of the present invention to at least partially solve the problems in the conventional technology.

A lighting apparatus according to one aspect of the present invention may include: a plurality of light sources; a first frame including a first reflection surface disposed inside of the light sources, the first reflection surface reflecting, in a forward direction, light emitted from the light sources; a second frame including a visor portion covering fronts of the light sources; and a diffuser disposed in front of a front surface of the visor portion with a distance left between the diffuser and at least a part of the front surface of the visor portion.

A lighting apparatus according to another aspect of the present invention may include: a light source; a first frame including a first reflection surface disposed sideward from the light source, the first reflection surface reflecting, in a forward direction, light emitted from the light source; a second frame including a visor portion covering a front of the light source; and a diffuser disposed in front of a front surface of the visor portion with a distance left between the diffuser and at least a part of the front surface of the visor portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
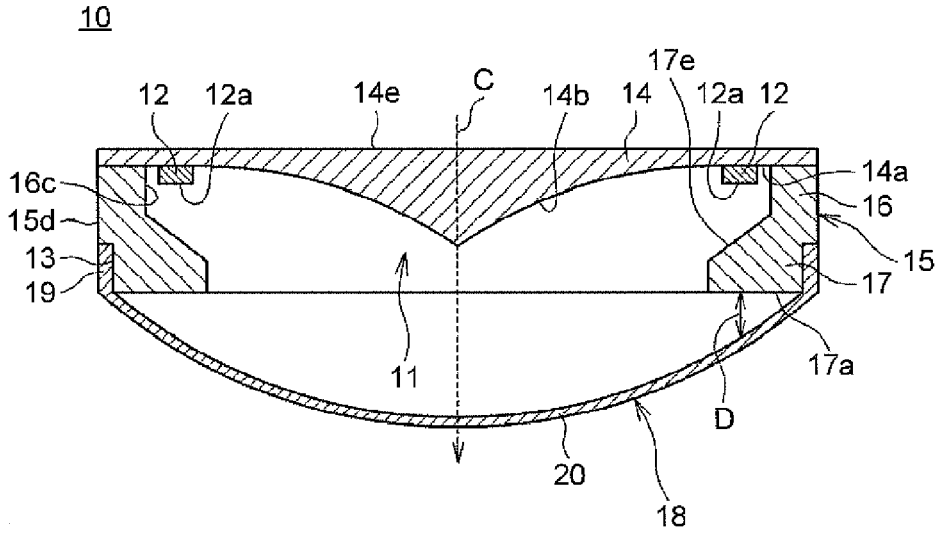
FIG. 1 is a sectional view illustrating main parts of a lighting apparatus according to a first embodiment of the present invention.

The embodiments of the present invention described below are examples of the configurations of the present invention. In order to facilitate the understanding of the various configurations of the present invention, the configurations are provided by aspects. Each aspect is not intended to limit the technical scope of the present invention. An aspect some of the constituent elements of which are substituted or deleted, or to which another constituent element is added, upon referring to the best modes for carrying out the invention, may also be included in the technical scope of the present invention.

The following describes embodiments of the present invention with reference to the accompanying drawings. The drawings (FIGS. 1 to 10) of the lighting apparatuses are schematic diagrams illustrating the main parts of the lighting apparatuses alone. The lighting apparatuses according to the embodiments of the present invention may include other constituent elements that are not illustrated in the drawings. The parts in the drawings are illustrated with emphasis on their characteristics to facilitate the explanation, and the relative dimensions thereof do not necessarily correspond to the actual reduced scale.

A lighting apparatus 10 according to a first embodiment of the present invention is formed in a circular shape when seen in a plan view with a central axis C being the rotation axis. FIG. 1 is a sectional view of the lighting apparatus 10 taken along a section including the central axis C. In FIG. 1, some structures inside the lighting apparatus 10 are not illustrated as appropriate to facilitate the understanding of the principles of the present invention (the same is true for FIGS. 2 to 10). The lighting apparatus 10 includes a plurality of light sources 12, a first frame 14 having a circular shape when seen in a plan view, a second frame 15 having a short cylindrical shape disposed in front of the first frame 14 (in the direction of the arrow of the central axis C in FIG. 1), and a diffuser 18 having a circular shape when seen in a plan view disposed in front of the second frame 15.

The first frame 14 has front surfaces 14*a* and 14*b* facing in the forward direction and a back surface 14*e* opposite to the front surfaces 14*a* and 14*b*. The back surface 14*e* is configured as a plane surface substantially perpendicular to the central axis C. The front surfaces 14*a* and 14*b* include an annular plane surface 14*a* that is substantially parallel to the back surface 14*e* and disposed on a circumference portion of the front surfaces 14*a* and 14*b*, and a first reflection surface 14*b* integrally provided with the first frame 14 and disposed in an inner side (close to the central axis C) of the plane surface 14*a*. In the example of FIG. 1, the light sources 12 are disposed on the plane surface 14*a* of the first frame 14. This configuration allows the first reflection surface 14*b* to be disposed inside the arrangement of the light sources 12.

The first reflection surface 14*b* is configured to reflect light emitted from the light sources 12 in a forward direction at a certain angle. In the example of FIG. 1, the first reflection surface 14*b* is configured as a curved surface curving with a center portion around the central axis C projecting forward. The curved surface in the sectional view taken from the circumferential end (an end connected to the plane surface 14*a*) to the central axis C has a parabolic shape curving convexly backward. The first reflection surface 14*b* may have light diffusibility and light reflectivity. The first frame 14 of the lighting apparatus 10 is formed, for example, by die casting using an aluminum alloy that has goad heat conductivity and light reflectivity.

The light sources 12 are annularly disposed on the plane surface 14*a* of the first frame 14 with their emitting surfaces 12*a* facing forward. The light sources 12 of the lighting apparatus 10 are configured by, for example, white LEDs. Typically, the light sources 12 are mounted on a circuit board (not illustrated), and are disposed on the plane surface 14*a* together with the circuit board. Alternatively, for example, the circuit board may be disposed on the back surface 14*e* of the first frame 14, and the light sources 12 may be disposed in positions corresponding to a plurality of holes (not illustrated) formed through from the back surface 14*e* to the plane surface 14*a*.

The second frame 15 has a visor portion 17 provided to cover the front of the light sources 12. In the example of FIG. 1, the second frame 15 has a cylinder portion 16 disposed on the outer circumference of the plane surface 14*a* of the first frame 14 to surround the light sources 12, and the visor portion 17 is provided on a front portion of the cylinder portion 16 and extends inward. In other words, the light sources 12 are disposed such that they are accommodated in a recessed part defined by the plane surface 14*a* of the first frame 14, an inner circumferential surface 16*c* of the cylinder portion 16 of the second frame 15, and a back surface 17*e* of the visor portion 17. This configuration allows the visor portion 17 to cover the front of the light sources 12. An opening 11 having a circular shape when seen in a plan view is provided in the inner side of the visor portion 17 of the second frame 15.

In the second frame 15, a second reflection surface is provided on the back surface 17*e* of the visor portion 17 that faces the light sources 12. The second reflection surface reflects light emitted from the light sources 12 to the first reflection surface 14*b* (the reference sign 17*e* is also given to the second reflection surface in the following description). In the example of FIG. 1, the second reflection surface 17*e* is configured as an inclined surface inclined such that its outer side (in other words, the base end of the visor portion 17) is positioned backward, and its inner side (in other words, the leading end of the visor portion 17) is positioned forward. Although, in the example of FIG. 1, the second reflection surface 17*e* is inclined at a constant angle, the second reflection surface 17*e* is not limited to such a configuration in the present invention. For example, the second reflection surface 17*e* may be a curved surface. A front surface 17*a*, opposite to the back surface 17*e*, of the visor portion 17 is configured as a plane surface substantially parallel to the back surface 14*e* of the first frame 14. An outer circumferential surface 15*d* of the second frame 15 is provided with a recessed portion 13 to which the diffuser 18 to be described later is fixed. The second frame 15 of the lighting apparatus 10 is made of, for example, a white resin.

The diffuser 18 is disposed in front of the front surface 17*a* of the visor portion 17 of the second frame 15 with a distance D left between the diffuser 18 and at least a part of the front surface 17*a*. In the example of FIG. 1, the diffuser 18 includes a cylindrical fixing portion 19 and a cover 20 connected to the front end of the fixing portion 19. The diffuser 18 is connected to the second frame 15 by fixing the fixing portion 19 to the recessed portion 13 of the second frame 15 by any appropriate method. The cover 20 is formed in a dome-like shape that covers all over the opening 11 and the front surface 17*a* of the visor portion 17 when the diffuser 18 is fixed to the second frame 15. The dome-shaped cover 20 of the diffuser 18 curves convexly forward from the outer circumferential surface 15*d* of the second frame 15 toward the inner side thereof, and the front surface 17*a* of the visor portion 17 is configured as a plane surface substantially perpendicular to the central axis C. This configuration allows the diffuser 18 to be disposed with the distance left between the front surface 17*a* and a portion of the cover 20 in front of the visor portion 17. The diffuser 18 of the lighting apparatus 10 is made of, for example, a milk-white material having diffusibility, and is formed in a shape having a substantially constant thickness.

Figure 2:
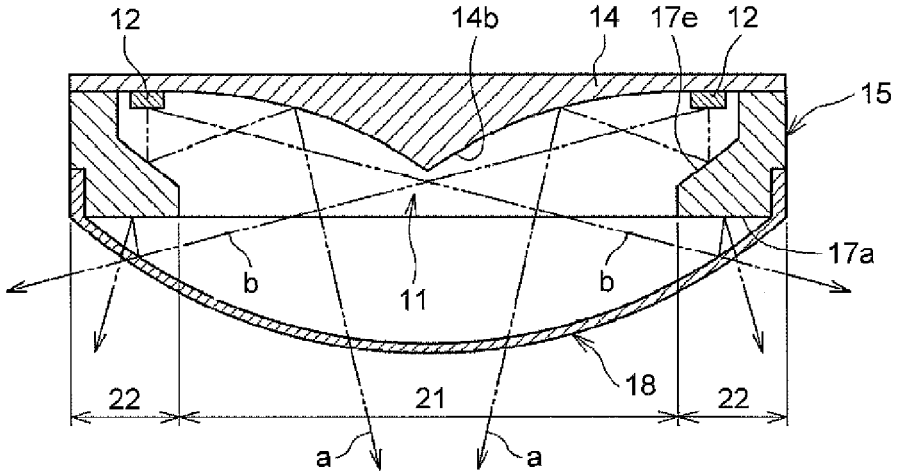
FIG. 2 is a sectional view illustrating operational effects of the lighting apparatus illustrated in FIG. 1.

The following describes the operational effects of the lighting apparatus 10 configured as described above with reference to FIGS. 1 and 2. In the lighting apparatus 10, light emitted from the light sources 12 in the forward direction (in particular, in a direction substantially parallel to the central axis C) is blocked by the visor portion 17 provided to cover the front of the light sources 12. This configuration never causes the light to be emitted directly from the lighting apparatus (in other words, never causes the light to be emitted without being reflected inside the lighting apparatus). Most of the light, the typical travelling paths of which are illustrated in FIG. 2 as travelling paths a, emitted from the light sources 12 in the forward direction is reflected on the second reflection surface 17*e* of the visor portion 17 and travels inward in a hollow light-guiding region defined by the first frame 14 and the second frame 15 to the first reflection surface 14*b*. The light is then reflected on the first reflection surface 14*b*, and travels in the front direction again to pass through the opening 11 provided in the inner side of the visor portion 17. The light is emitted to the outside from a portion (hereinafter also referred to as an opening facing portion) 21 of the diffuser 18 that faces the opening 11. With this configuration, the opening facing portion 21 of the diffuser 18 functions as a light-emitting surface of the lighting apparatus 10 having a circular shape when seen in a plan view.

The configuration described above enables the lighting apparatus 10 to carry out the basic functions of a hollow side-lit lighting apparatus, and also enables the lighting apparatus 10 to effectively reduce unevenness in brightness and glare on the light-emitting surface of the lighting apparatus 10 when seen from the illuminated side. The lighting apparatus 10 has such an advantageous feature of the hollow side-lit lighting apparatus, and also has another feature that causes a portion (hereinafter also referred to as a visor facing portion) 22 that faces the front surface 17*a* of the visor portion 17 to function as a light-emitting surface in addition to the opening facing portion 21 of the diffuser 18. Described next are details of this feature.

In the lighting apparatus 10, the diffuser 18 is disposed in front of the front surface 17*a* of the visor portion 17 with the distance D left between the front surface 17*a* and the diffuser 18. A part of the light, the typical travelling paths of which are illustrated in FIG. 2 as travelling paths b, emitted from the light sources 12 passes through the space defined by the distance D and enters the visor facing portion 22 of the diffuser 18. The light that has entered the visor facing portion 22 is diffused, and a part of the diffused light is emitted to the outside from the visor facing portion 22, and another part of the diffused light is emitted backward and enters the front surface 17*a* of the visor portion 17. The light that has entered the front surface 17*a* of the visor portion 17 is reflected (regular reflection or diffused reflection) thereon, and at least a part of the light enters the visor facing portion 22 again. This re-entering light is diffused in the visor facing portion 22, and the processes described above are repeated.

Repeating such processes in the lighting apparatus 10 causes the front surface 17*a* of the visor portion 17 to substantially function as an emitting surface from which light is emitted in the forward direction, and eventually causes the visor facing portion 22 of the diffuser 18 to function as a light-emitting surface having an annular shape when seen in a plan view. In other words, the lighting apparatus 10 has a light-emitting surface configured, in a circular shape as a whole when seen in a plan view, by the circular light-emitting surface when seen in a plan view including the opening facing portion 21 of the diffuser 18 and the annular light-emitting surface when seen in a plan view including the visor facing portion 22 of the diffuser 18 connected along the circumference of the circular light-emitting surface.

Thus, the entire front face of the lighting apparatus 10 serves as a light-emitting surface configured by the opening facing portion 21 and the visor facing portion 22 of the diffuser 18. This configuration enables the lighting apparatus 10 to have a broad (in this case, broadest) light-emitting surface relative to the front face of the lighting apparatus while effectively reducing the unevenness in brightness and glare on the light-emitting surface when seen from the illuminated side. This configuration can also eliminate the rim frame around the light-emitting surface, which can provide a lighting apparatus that is excellent in appearance.

In the lighting apparatus 10, the surface roughness of the front surface 17*a* of the visor portion 17 of the second frame 15 may differ from that of the back surface 17*e* thereof. Determining the appropriate surface roughness of the front surface 17*a* and that of the back surface 17*e* of the visor portion 17 can adjust the degree of diffusibility of reflected light on the front surface 17*a* and the back surface 17*e*, and thus the brightness of the visor facing portion 22 of the diffuser 18 or the uniformity of brightness thereof can be adjusted. In particular, setting the front surface 17*a* of the visor portion 17 to be rougher than the back surface (that is, the second reflection surface) 17*e* to increase the diffusibility of reflected light on the front surface 17*a* of the visor portion 17 can increase the brightness of the visor facing portion 22 of the diffuser 18 or improve the uniformity in brightness thereof.

In some embodiments, the diffuser 18 of the lighting apparatus 10 does not necessarily have a constant thickness. For example, the thickness of the opening facing portion 21 may differ from that of the visor facing portion 22 in the cover 20 (for example, the visor facing portion 22 may be thicker than the opening facing portion 21).

In the lighting apparatus 10, the light sources 12 are disposed such that their optical axes (typically, axes that are perpendicular to the respective emitting surfaces 12*a*) that are the reference axes for light distribution are arranged substantially parallel to the central axis C. In some embodiments, the optical axes of the light sources 12 of the lighting apparatus 10 are not necessarily substantially parallel to the central axis C. For example, the light sources 12 may be disposed with their optical axes extending inward (toward the central axis C), that is, with their optical axes inclined inward.

Described next are various modifications of the lighting apparatus according to the first embodiment of the present invention with reference to FIGS. 3 to 9. The following descriptions of the modifications omit the explanation of the same features as those of the lighting apparatus 10 described with reference to FIGS. 1 and 2, and mainly explain features different from those of the lighting apparatus 10.

Figure 3:
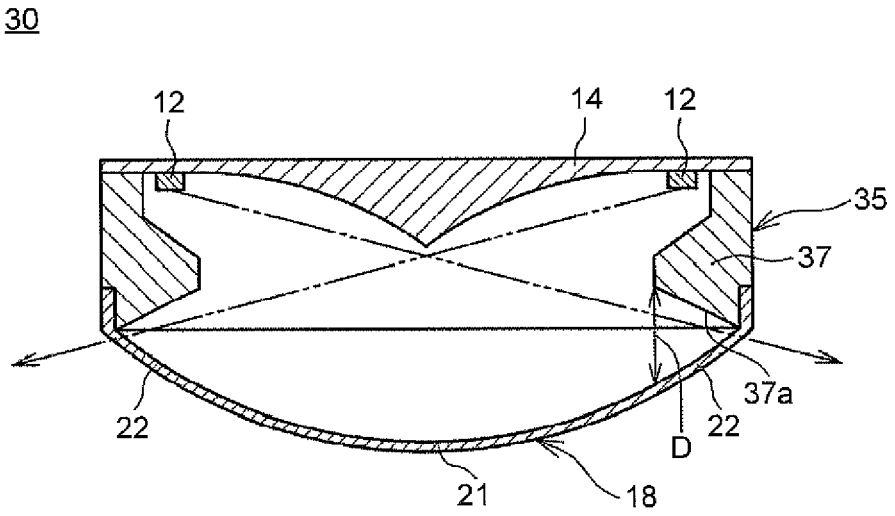
FIG. 3 is a sectional view illustrating the main parts of another example of the lighting apparatus according to the first embodiment of the present invention.

A lighting apparatus 30 illustrated in FIG. 3 differs from the lighting apparatus 10 in that it has a front surface 37*a* of a visor portion 37 of a second frame 35 that has an inclined portion inclined in the front-back direction so that the outer side of the visor portion 37 is positioned forward relative to the inner side thereof. In the example of FIG. 3, the entire front surface 37*a* is configured as an inclined surface that is inclined in the front-back direction, and the inclined surface configures the inclined portion described above.

In the lighting apparatus 30, the space defined by the distance D between the front surface 37*a* of the visor portion 37 and the visor facing portion 22 of the diffuser 18 has a shape widening toward the inner side. Such a widening shape can more easily guide light emitted from the light sources 12 to the visor facing portion 22 of the diffuser 18. This configuration can increase the brightness of the visor facing portion 22 of the diffuser 18.

Figure 4:
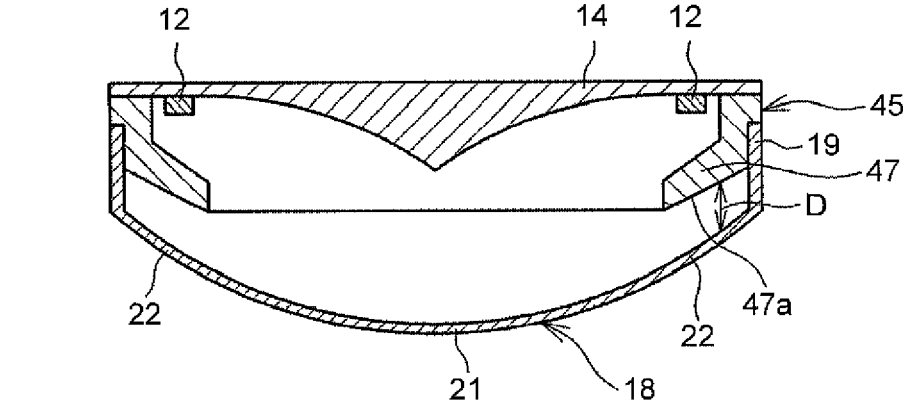
FIG. 4 is a sectional view illustrating the main parts of still another example of the lighting apparatus according to the first embodiment of the present invention.

A lighting apparatus 40 illustrated in FIG. 4 differs from the lighting apparatus 10 in that it has a front surface 47*a* of a visor portion 47 of a second frame 45 that has an inclined portion inclined in the front-back direction so that the outer side of the visor portion 47 is positioned backward relative to the inner side thereof. In the example of FIG. 4, the entire front surface 47*a* is configured as an inclined surface inclined in the front-back direction, and the inclined surface configures the inclined portion described above.

This configuration enables the lighting apparatus 40 to have a relatively large distance D over a wide range (preferably over the entire range) of a space between the front surface 47*a* of the visor portion 47 and the visor facing portion 22 of the diffuser 18. The inventors have found out that a larger distance D (in other words, a larger space defined by the distance D) increases the brightness of the visor facing portion 22 of the diffuser 18, and thus the lighting apparatus 40 is advantageous. In the lighting apparatus 40, the fixing portion 19 of the diffuser 18 is fixed to the second frame 45 at a position closer to the first frame 14. Such positioning can reduce the thickness (length in the front-back direction) of the lighting apparatus. This feature of the lighting apparatus 40 can cause the lighting apparatus to be thinner to increase the brightness of the visor facing portion 22 of the diffuser 18, and thus, the lighting apparatus 40 is more advantageous than, for example, the lighting apparatus 30 illustrated in FIG. 3.

Figure 5:
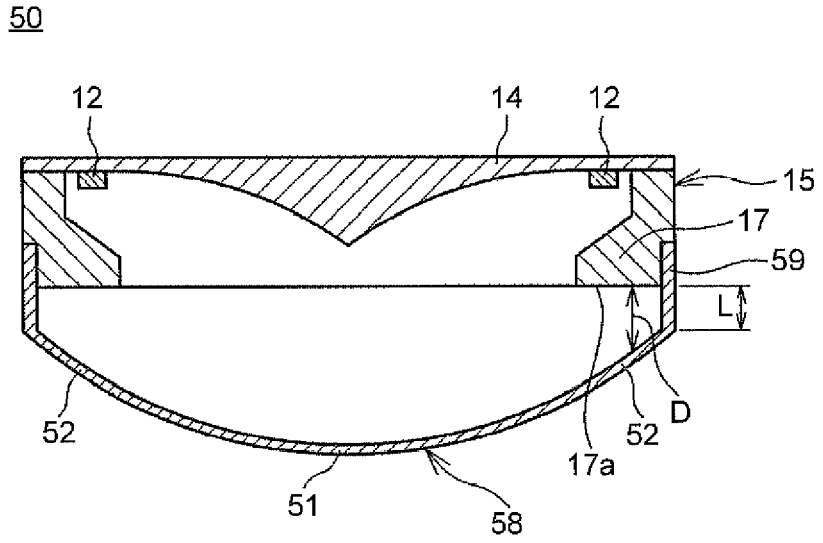
FIG. 5 is a sectional view illustrating the main parts of yet another example of the lighting apparatus according to the first embodiment of the present invention.

A lighting apparatus 50 illustrated in FIG. 5 differs from the lighting apparatus 10 in that it includes a longer fixing portion 59 of a diffuser 58 so that the fixing portion 59 is disposed with its front portion projecting from the second frame 15 by a certain length L.

Although this configuration causes the lighting apparatus 50 to be thicker than the lighting apparatus 40 illustrated in FIG. 4, the configuration allows the lighting apparatus 50 to have the same effect as that of the lighting apparatus 40 in that the lighting apparatus 50 can have a relatively large distance D over a wide range (preferably, over the entire range) of a space between the front surface 17*a* of the visor portion 17 and a visor facing portion 52 of the diffuser 58, and thus, the brightness of the visor facing portion 52 of the diffuser 58 can be increased.

Figure 6:
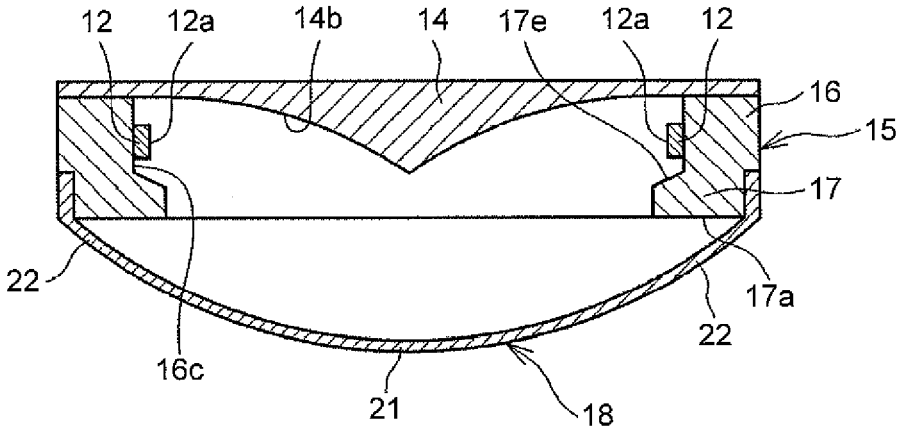
FIG. 6 is a sectional view illustrating the main parts of still another example of the lighting apparatus according to the first embodiment of the present invention.

A lighting apparatus 60 illustrated in FIG. 6 differs from the lighting apparatus 10 in that it includes the light sources 12 on an inner surface 160 of the cylinder portion 16 of the second frame 15. In the example of FIG. 6, the light sources 12 are disposed with the emitting surfaces 12*a* facing inward so that their optical axes cross the central axis C at a substantially right angle.

In the lighting apparatus 60, out of the light emitted from the light sources 12, a larger amount of light travels toward the visor facing portion 22 of the diffuser 18, and thus, the brightness of the visor facing portion 22 of the diffuser 18 increases. In this case, the light sources 12 may be disposed such that their optical axes are tilted in the forward direction with respective to the direction perpendicular to the central axis C so as to increase the amount of light travelling toward the visor facing portion 22 of the diffuser 18. When the light sources 12 are disposed on the second frame 15 as described above, the second frame 15 may be formed by die casting using an aluminum alloy, and the first frame 14 may be formed of a white resin. When disposing the light sources 12 on the second frame 15 reduces the ratio of light entering the back surface 17*e* of the visor portion 17 with respect to the light directly entering the first reflection surface 14*b* of the first frame 14 out of the light emitted from the light sources 12, the second reflection surface 17*e* may be eliminated from the back surface 17*e* of the visor portion 17.

Figure 7:
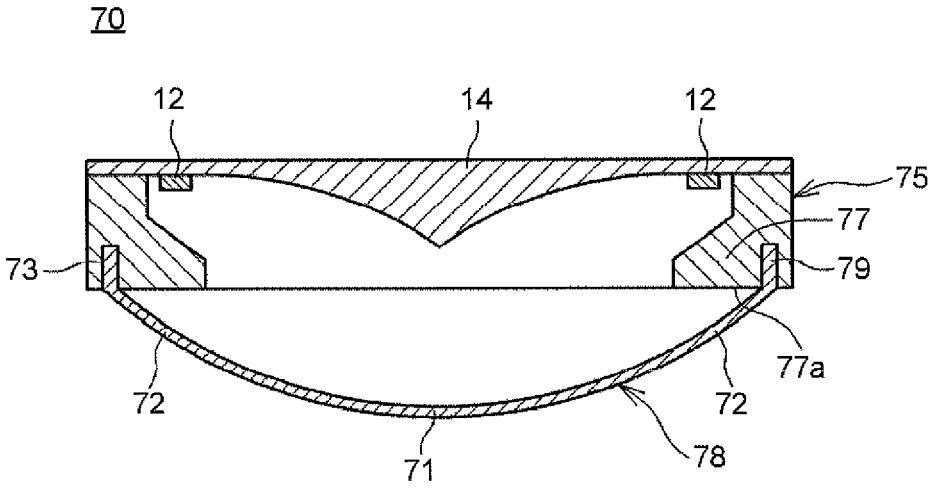
FIG. 7 is a sectional view illustrating the main parts of yet another example of the lighting apparatus according to the first embodiment of the present invention.

A lighting apparatus 70 illustrated in FIG. 7 differs from the lighting apparatus 10 in that it includes a groove 73 on a front surface 77*a* of a visor portion 77 of a second frame 75, and a diffuser 78 fixed to the second frame 75 with a fixing portion 79 of the diffuser 78 inserted into the groove 73.

Although the lighting apparatus 70 includes a non-light-emitting surface (rim frame) in a portion outer than the groove 73, which is a portion of the front surface 77*a* of the visor portion 77 of the second frame 75, the other portion of the front surface 77*a* of the visor portion 77 inside the groove 73 is covered by a visor facing portion 72 of the diffuser 78. This configuration enables the lighting apparatus 70 to have a broad light-emitting surface configured by an opening facing portion 71 and the visor facing portion 72 with respect to the front face of the lighting apparatus, and also to narrow the rim frame around the light-emitting surface, which can provide a lighting apparatus 70 that is excellent in appearance.

Figure 8:
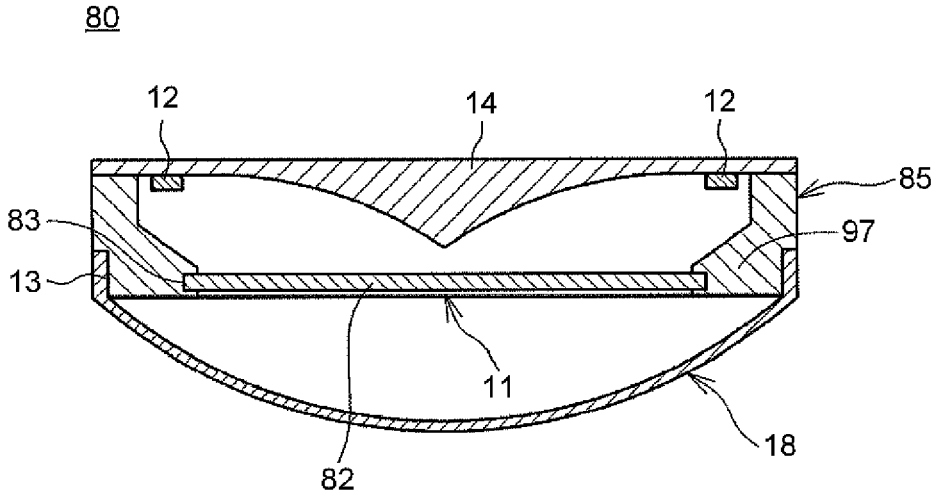
FIG. 8 is a sectional view illustrating the main parts of still another example of the lighting apparatus according to the first embodiment of the present invention.

A lighting apparatus 80 illustrated in FIG. 8 differs from the lighting apparatus 10 in that it includes a light distribution controller (for example, a diffusing plate) 82 at the opening 11 of the second frame 15. With this configuration, the lighting apparatus 80 can more precisely control the entire brightness of the diffuser 18. It is preferable that the light distribution controller 82 and the diffuser 18 are detachable from the lighting apparatus 80. With this configuration, users can use either the light distribution controller 82 or the diffuser 18, or both, so that a single lighting apparatus can flexibly meet the specifications required for lighting apparatuses.

Figure 9:
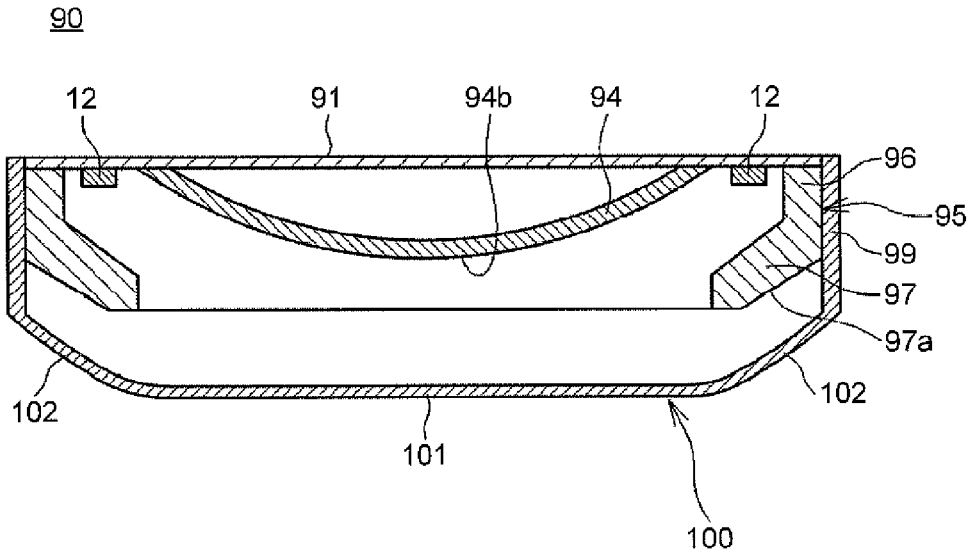
FIG. 9 is a sectional view illustrating the main parts of yet another example of the lighting apparatus according to the first embodiment of the present invention.

The lighting apparatus according to the first embodiment may include, as a lighting apparatus 90 illustrated in FIG. 9 does, a dome-shaped first frame 94 protruding convexly forward on a circuit board 91 on which the light sources 12 are mounted. An opening facing portion 101 of a diffuser 100 may be formed in a flat shape (the diffuser 100 as a whole may be formed in a cylindrical shape with a flat bottom). When a visor portion 97 of a second frame 95 has an inclined front surface 97*a*, a visor facing portion 102 of the diffuser 100 may be configured to incline in accordance with the gradient of the front surface 97*a*. The second frame 95 and the diffuser 100 may be fixed to each other by inserting the second frame 95 into a fixing portion 99 of the diffuser 100.

The lighting apparatus according to the first embodiment may include the features of the lighting apparatuses 10, 30, 40, 50, 60, 70, 80, and 90, which have been explained individually, joined together as appropriate if the combination is technically possible. Although, in the above descriptions, the lighting apparatuses 10, 30, 40, 50, 60, 70, 80, and 90 have a circular, light-emitting surface when seen in a plan view, the lighting apparatus according to the first embodiment may include a certain polygonal light-emitting surface. In this case, constituent elements having a circular or annular shape in the above descriptions are configured to be formed in a shape corresponding to the certain polygonal shape as appropriate. Such a polygonal shape is preferably symmetrical about a certain virtual plane including an optical axis C.

In particular, when the lighting apparatus (lighting apparatus 10, for example) according to the first embodiment has a rectangular light-emitting surface, the light sources 12 may be aligned in two rows that are parallel to each other and face each other. In other words, assuming that FIG. 1 is a sectional view of a lighting apparatus having a rectangular light-emitting surface, the light sources 12 are disposed along both sides of the rectangular light-emitting surface facing each other (in other words, two sides of the rectangular opening 11 facing each other), that is, some light sources 12 are aligned on one side (on the left side in FIG. 1, for example) with respect to the central axis C in the vertical direction from the plane of the drawing, and the other light sources 12 are aligned on the other side (on the right side in FIG. 1, for example) with respective to the central axis C in the vertical direction from the plane of the drawing.

In this case, the light sources 12 disposed on one side and on the other side are not necessarily arranged symmetrically. For example, the light sources 12 on one side may be disposed (on, for example, the first frame 14) with their emitting surfaces 12*a* facing forward, and the light sources 12 on the other side may be disposed (on, for example, the second frame 15) with their emitting surface 12*a* facing inward.

When the lighting apparatus 10 has a rectangular light-emitting surface, the first frame 14 and the second frame 15 may be integrally formed by, for example, extrusion molding. Features of the lighting apparatus having a rectangular light-emitting surface, which have been described by using the lighting apparatus 10 as an example, are also applicable to the other lighting apparatuses 30, 40, 50, 60, 70, 80, and 90, and to a lighting apparatus having features of the lighting apparatuses 10, 30, 40, 50, 60, 70, 80, and 90 joined together as appropriate.

When the lighting apparatus 80 illustrated in FIG. 8 has a rectangular light-emitting surface, the light distribution controller 82 is preferably slidably fitted to grooves 83 to which the light distribution controller 82 is to be fitted and the diffuser 18 is preferably slidably fitted to the recessed portion 13 to which a cylindrical fixing portion 19 of the diffuser 18 is to be fitted. This configuration allows the light distribution controller 82 and the diffuser 18 to be easily attached and detached.

Figure 10:
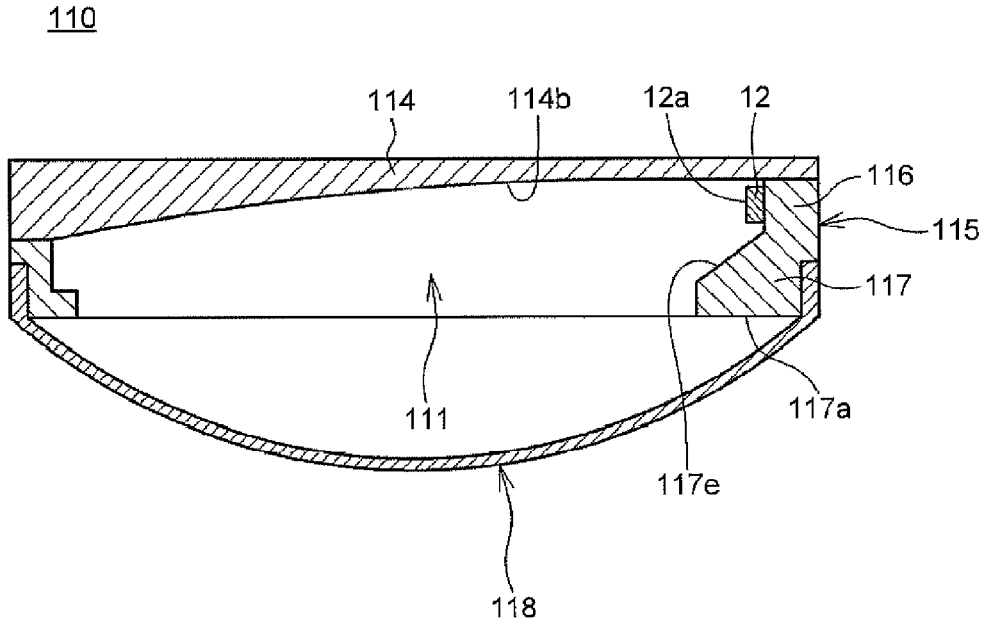
FIG. 10 is a sectional view illustrating main parts of a lighting apparatus according to a second embodiment of the present invention.

Described next is a lighting apparatus 110 according to a second embodiment of the present invention with reference to FIG. 10. The following description omits the explanation of the same features as those of the lighting apparatus (the lighting apparatus 10, for example) according to the first embodiment, and mainly explains features different from those of the lighting apparatus according to the first embodiment.

The lighting apparatus 110 is an embodiment of a lighting apparatus having a rectangular light-emitting surface. The lighting apparatus 110 differs from a lighting apparatus 10 having a rectangular light-emitting surface mainly in that the light sources 12 of the lighting apparatus 110 are disposed only on one side of a rectangular opening 111. In other words, in the lighting apparatus 110, a first reflection surface 114*b* of a first frame 114 is disposed sideward from the light sources 12. Although, it may be sufficient for the lighting apparatus 110 to include one or more light sources 12 in this respect, the lighting apparatus 110 may preferably include a plurality of light sources 12 that are aligned in the vertical direction from the plane of the drawing of FIG. 10. The lighting apparatus 110 includes a second frame 115 having a visor portion 117 that covers the front of the light sources 12, and a diffuser 118 is disposed in front of a front surface 117*a* of the visor portion 117 with a certain distance left between the diffuser 118 and at least a part of the front surface 117*a*. This configuration is the same as that of the lighting apparatus (lighting apparatus 10, for example) according to the first embodiment. Thus, the lighting apparatus 110 has the same operational effects as those of the lighting apparatus 10.

In the lighting apparatus 110, the light sources 12 are disposed on the second frame 115 with their emitting surfaces 12*a* facing a side of the lighting apparatus 110 that is opposite to the side on which the light sources 12 are disposed. The first reflection surface 114*b* in the lighting apparatus 110 is formed in a curved shape that curves forward as it extends from a side immediately above the light sources 12 or a nearby place to the other side of the first reflection surface 114*b*. The sectional view illustrated in FIG. 10 exhibits parabola.

The lighting apparatus 110 configured as described above can be preferably used as what is called an under-shelf lighting apparatus installed in a display shelf that displays, for example, merchandise. The under-shelf lighting apparatus is installed, for example, on the bottom surface of a shelf board of the display shelf at the front side (or back side) thereof to uniformly illuminate the whole area of the immediately below shelf.

The lighting apparatus 110 according to the second embodiment may include the features of the lighting apparatuses relating to the first embodiment that have been described with reference to FIGS. 3 to 9. The lighting apparatus 110 may include the features individually, or may include features joined together as appropriate. The lighting apparatus 110 may also include the features of the lighting apparatuses relating to the first embodiment that have a rectangular light-emitting surface if the features are technically possible.

The lighting apparatus has the first reflection surface disposed inside the arrangement of the light sources to reflect light emitted from the light sources in a forward direction, and the visor portion is disposed to cover the front of the light sources. This configuration prevents light emitted from the light sources in the forward direction from being directly emitted from the lighting apparatus. Most of the light emitted from the light sources is reflected on the first reflection surface and then emitted from the lighting apparatus. Thus, unevenness in brightness and glare on the light-emitting surface is effectively reduced when seen from the illuminated side.

In the lighting apparatus, the diffuser is disposed in front of the front surface of the visor portion with a distance left between the diffuser and at least a part of the front surface. A part of the light emitted from the light sources passes through the space defined by the distance, and enters a portion (hereinafter referred to as a visor facing portion) of the diffuser that faces the front surface of the visor portion. The light that has entered the visor facing portion of the diffuser is diffused, and a part of the diffused light is emitted to the outside while another part thereof travels backward to enter the front surface of the visor portion. The light that has entered the front surface of the visor portion is reflected thereon (regular reflection or diffused reflection), and at least a part of the reflected light enters the visor facing portion again. The re-entering light is diffused in the visor facing portion, and the processes described above are repeated. The lighting apparatus according to the above aspect repeats such processes, whereby the front surface of the visor portion substantially functions as an emitting surface from which light is emitted in the forward direction, and eventually, the visor facing portion of the diffuser functions as a light-emitting surface. The light-emitting surface configured by the visor facing portion is added to a light-emitting surface corresponding to the opening provided in the inner side of the visor portion, and the entire light-emitting surface of the lighting apparatus is thus configured.

This configuration enables the lighting apparatus to have a broad light-emitting surface on the front face (the entire front face of the lighting apparatus including the surface in front of the visor portion) of the lighting apparatus, or this configuration can cause the entire front face of the lighting apparatus to serve as the light-emitting surface. Accordingly, the rim frame around the light-emitting surface is narrowed or eliminated, which can provide a lighting apparatus that is excellent in appearance.

The lighting apparatus may have a brighter visor facing portion of the diffuser.

The lighting apparatus may more easily guide the light emitted from the light sources into the space defined by the distance between the front surface of the visor portion and the diffuser, whereby the brightness of the visor facing portion of the diffuser can be increased effectively.

The lighting apparatus may increase the brightness of the visor facing portion of the diffuser, and reduce the thickness (length in the front-back direction) of the lighting apparatus.

The lighting apparatus may adjust the brightness of the visor facing portion of the diffuser or the uniformity of brightness thereof by appropriately determining the surface roughness of the front surface of the visor portion and the surface roughness of the surface opposite to the front surface. It is preferable, in the lighting apparatus according to the above aspect, that the front surface of the visor portion is rougher than the opposite surface. This configuration can make the visor facing portion of the diffuser brighter, or improve the uniformity of brightness thereof.

The lighting apparatus may adjust the brightness of the entire light-emitting surface more precisely.

The lighting apparatus may be preferably configured to have a circular light-emitting surface.

The lighting apparatus may be preferably configured to have a rectangular light-emitting surface.

The lighting apparatus may effectively reduce the unevenness in brightness and glare on the light-emitting surface when seen from the illuminated side, by the same mechanisms as those described in the aspect relating to claim 1. Moreover, the rim frame around the light-emitting surface may be narrowed or eliminated, which can provide a lighting apparatus that is excellent in appearance.

When the lighting apparatus has, in particular a long rectangular light-emitting surface, it may uniformly illuminate the entire illuminated area by disposing the light source on one side of the two sides along the longitudinal direction of the light-emitting surface. The lighting apparatus having such a configuration may be preferably used as what is called an under-shelf lighting apparatus installed in a display shelf that displays, for example, merchandise. The under-shelf lighting apparatus is installed, for example, on the bottom surface of a shelf board of the display shelf at the front side (or back side) thereof to uniformly illuminate the whole area of the immediately below shelf.

The lighting apparatus configured as described above may provide a broad light-emitting surface while effectively reducing unevenness in brightness and glare on the light-emitting surface.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lighting apparatus comprising:

a plurality of light sources;

a first frame including a first reflection surface disposed between the light sources, the first reflection surface reflecting, in a forward direction, light emitted from the light sources;

a second frame including a visor portion covering fronts of the light sources; and a diffuser disposed in front of a front surface of the visor portion with a distance left between the diffuser and at least a part of the front surface of the visor portion, wherein the diffuser has a size so as to cover at least the fronts of the light sources, and is connected to the front surface of the visor portion at an outside of a space between the plurality of light sources.

2. The lighting apparatus according to claim 1, wherein the front surface of the visor portion includes an inclined portion inclined in a front-back direction.

3. The lighting apparatus according to claim 2, wherein the inclined portion is inclined such that an outer side of the visor portion is positioned forward relative to an inner side of the visor portion.

4. The lighting apparatus according to claim 2, wherein the inclined portion is inclined such that an outer side of the visor portion is positioned backward relative to an inner side of the visor portion.

5. The lighting apparatus according to claim 1, wherein surface roughness of the front surface of the visor portion differs from surface roughness of a surface opposite to the front surface.

6. The lighting apparatus according to claim 1, further comprising a light distribution controller disposed at an opening provided in an inner side of the visor portion.

7. The lighting apparatus according to claim 1, wherein the plurality of the light sources are disposed annularly.

8. The lighting apparatus according to claim 1, wherein the plurality of the light sources are aligned in two rows that are parallel to each other.

9. A lighting apparatus comprising:

a light source;

a first frame including a first reflection surface disposed sideward at one side of the light source, the first reflection surface reflecting, in a forward direction, light emitted from the light source;

a second frame including a visor portion covering a front of the light source; and a diffuser disposed in front of a front surface of the visor portion with a distance left between the diffuser and at least a part of the front surface of the visor portion, wherein the diffuser has a size so as to cover at least a front of the light source, and is connected to the front surface of the visor portion at an other side of the light source.

* * * * *